US007398905B2

(12) United States Patent
Chen et al.

(10) Patent No.: US 7,398,905 B2
(45) Date of Patent: Jul. 15, 2008

(54) ANTI-MISFIT STRUCTURE FOR A NAIL CARTRIDGE

(75) Inventors: Jack Chen, Taichung (TW); Tsung-Min Hsu, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/622,917

(22) Filed: Jan. 12, 2007

(65) Prior Publication Data

US 2007/0164075 A1 Jul. 19, 2007

(30) Foreign Application Priority Data

Jan. 17, 2006 (TW) ..... 95101750 A

(51) Int. Cl.
*B25C 5/00* (2006.01)
*B25C 5/16* (2006.01)

(52) U.S. Cl. ..... 227/119; 227/135; 227/156

(58) Field of Classification Search ..... 227/120, 227/109, 119, 115, 135, 156, 136
See application file for complete search history.

(56) References Cited

U.S. PATENT DOCUMENTS 4,815,647 A * 3/1989 Chou ..... 227/109
5,522,533 A * 6/1996 Mukoyama et al. ..... 227/109
5,897,046 A * 4/1999 Oehri et al. ..... 227/119
6,345,754 B1 * 2/2002 Jeng ..... 227/109
6,502,737 B2 * 1/2003 Akiba ..... 227/109
6,808,101 B2 * 10/2004 Laubach et al. ..... 227/109
6,851,594 B1 * 2/2005 Huang ..... 227/109
6,908,021 B1 * 6/2005 Wang ..... 227/8
6,910,611 B2 * 6/2005 Chi ..... 227/109
7,028,875 B1 * 4/2006 Beville et al. ..... 227/8
7,172,103 B2 * 2/2007 Fujiyama et al. ..... 227/120

* cited by examiner

*Primary Examiner*—Paul R Durand
(74) *Attorney, Agent, or Firm*—Egbert Law Group

(57) ABSTRACT

The present invention provides an anti-misfit structure for a nail cartridge, which resolves the problems of a typical nail cartridge. For example, when a short collated nail is mistakenly inserted, it is likely lead to different triggering strength, and easier swinging and jamming of nail bodies against stability and safety. The swinging end of the spring of the nail cartridge is provided with a stopper. So, when the nailer head of a short collated nail is mistakenly inserted into the long nailer head dent, the stopper blocks the collated nail, thus preventing any misalignment and subsequent triggering of a nailer for higher stability and safety.

7 Claims, 10 Drawing Sheets

ANTI-MISFIT STRUCTURE FOR A NAIL CARTRIDGE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a structure of a nail cartridge, and more particularly to an innovative anti-misfit structure for a nail cartridge.

2. Description of Related Art Including Information Disclosed Under 37 CFR 1.97 and 37 CFR 1.98.

The nail cartridge is used to accommodate and guide collated nails.

The collated nails are rows of nail bodies linked by a connecting band. Given the currently available types of nailers, the present invention relates more particularly to a nailer with a T-shaped profile, namely, wherein the nails of the nailer have an expanded nail head.

FIG. 1 depicts the typical nail cartridge 10, wherein a nail tank 11 is generally provided with a spring 12 to insert the collated nails for flexible positioning. According to the specified pattern of the nail body, the inlet 13 of the nail tank 11 is formed into a T-shaped inlet to match the collated nails for stable motion. The marketable nail bodies of collated nails are divided into two types. As such, upper and lower T-shaped inlets 131, 132 are located at inlet 13 of nail tank 11 in the nail cartridge 10. If longer collated nails 20*a* are inserted, as shown in FIG. 1, the nail head 22*a* of nail body 21*a* aligns with the upper T-shaped inlet 131 for insertion. Otherwise, if shorter collated nails 20*b* are inserted, as shown in FIG. 2, the nail head 22*b* of nail body 21*b* aligns with lower T-shaped inlet 132 for insertion (as shown for the location of collated nails represented by the broken line in FIG. 2).

This nail cartridge has disadvantages during application. If longer collated nails are inserted and if the maximum size of the inlet of the nail tank matches the longer collated nail, then it is impossible to load nails smoothly because any misalignment or directional errors would affect loading, as shown in FIG. 1. If shorter collated nails 20*b* are inserted and if inlet 13 of the nail tank 11 has upper and lower T-shaped inlets 131, 132, then it is possible to load the shorter collated nails 20*b* smoothly into upper T-shaped inlet 131, even with misalignment, as shown in FIG. 2. However, if shorter collated nails are triggered in such a state, the nail ejection strength is far below the expectation due to a longer distance between the bottom of nail body 21*b* and ejection hole of the nailer. Furthermore, the shorter collated nails triggered in such a state provide a bigger probability of deflection and jamming with increasing instability and risk to nailer applications.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

The present invention includes a swinging end 62 of the spring 60 of nail cartridge 30 being provided with a stopper 70. When the nail head 51*b* of a short collated nail 50*b* is mistakenly inserted into the long nail head dent 321, the stopper 70 blocks the short collated nail 50*b*. This blocking prevents misalignment and subsequent triggering, enabling a more stable and more safe nailer.

The present invention also includes an end wall 41 of nail tank 31 of the nail cartridge 30 being provided with a relief groove 42. When triggering is finished, the collated nail shifts towards the outlet 40 until the nailer head stops at the end wall 41 of outlet. The end 54 of connecting band 53 exceeding the nail head 51*b* inserts into the relief groove 42, ensuring that the nail head 51*b* stops at the end wall 41 of the outlet 40 for a correct triggering.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
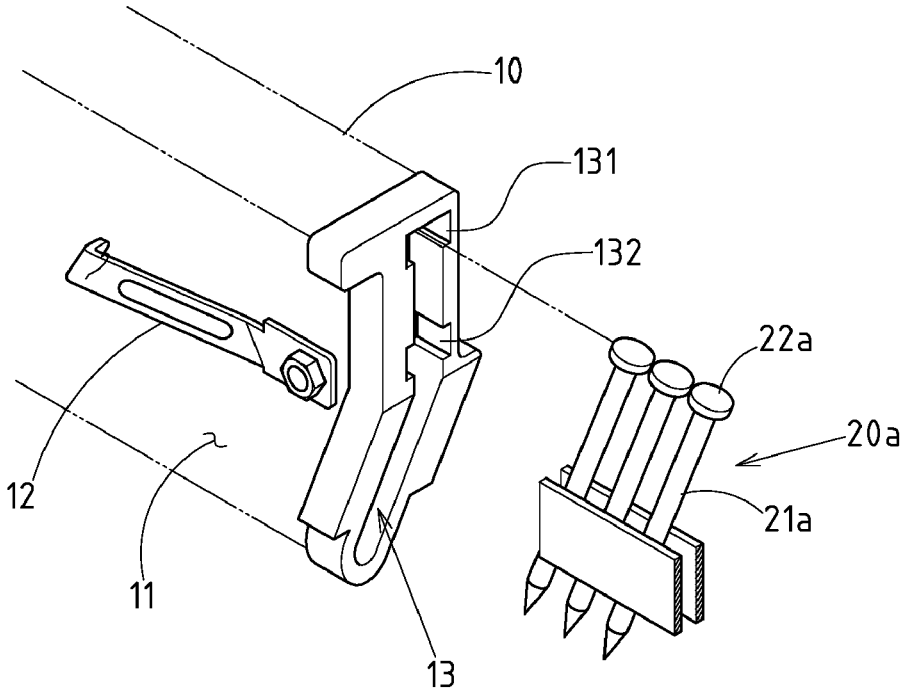
FIG.1 PRIOR ART
FIG. 1 shows an isolated perspective view of long collated nails being installed into the nail cartridge.
Figure 2:
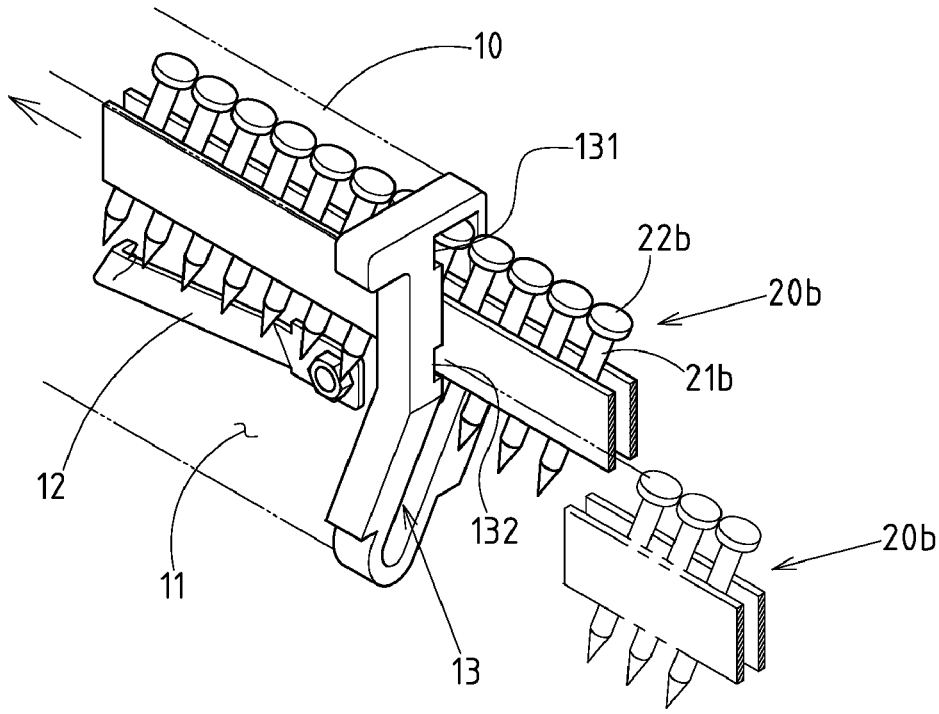
FIG.2 PRIOR ART
FIG. 2 shows an exploded and isolated perspective view of short collated nails being correctly and incorrectly installed into the nail cartridge.
Figure 3:
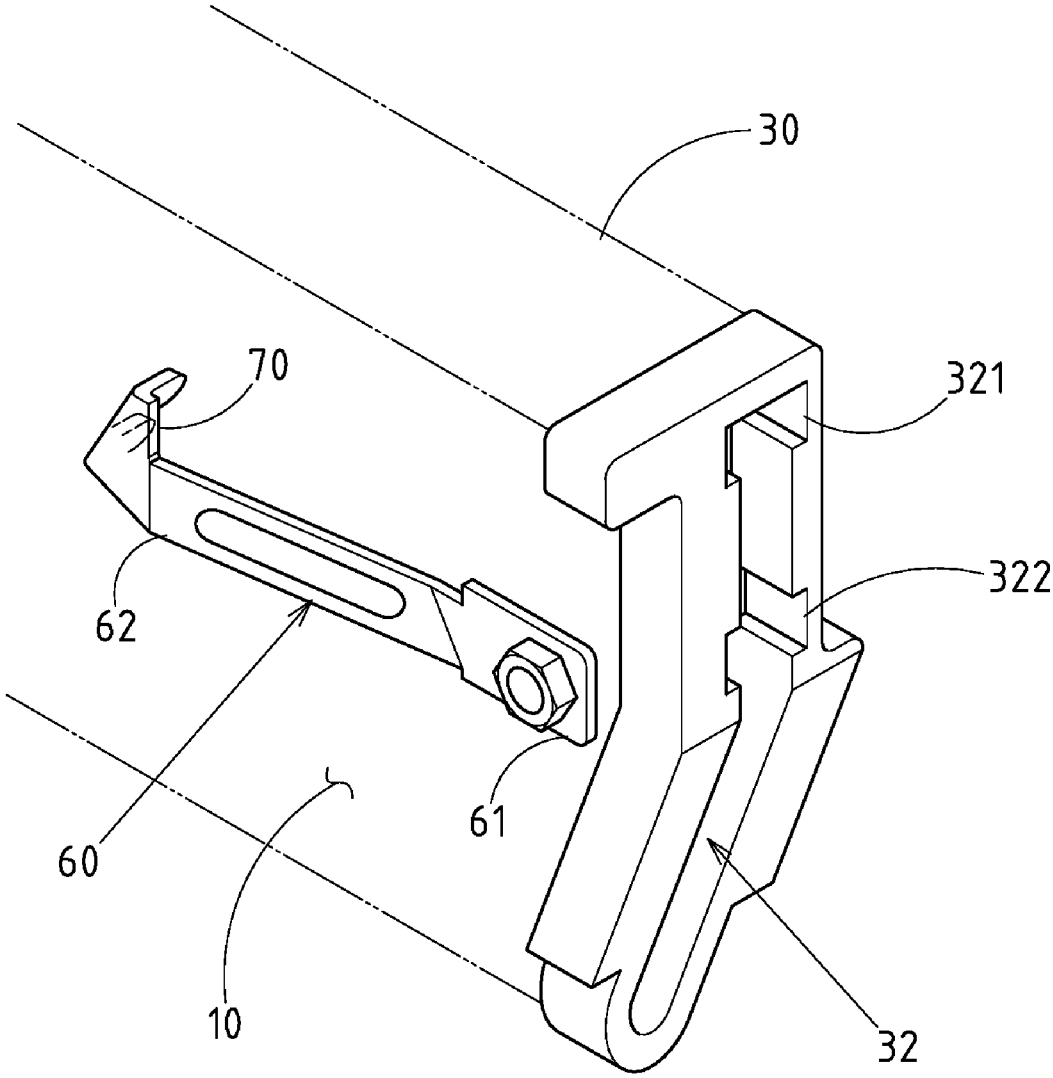
FIG. 3 shows an isolated perspective view of a spring when no collated nails are installed into the nail cartridge of the present invention.
Figure 4:
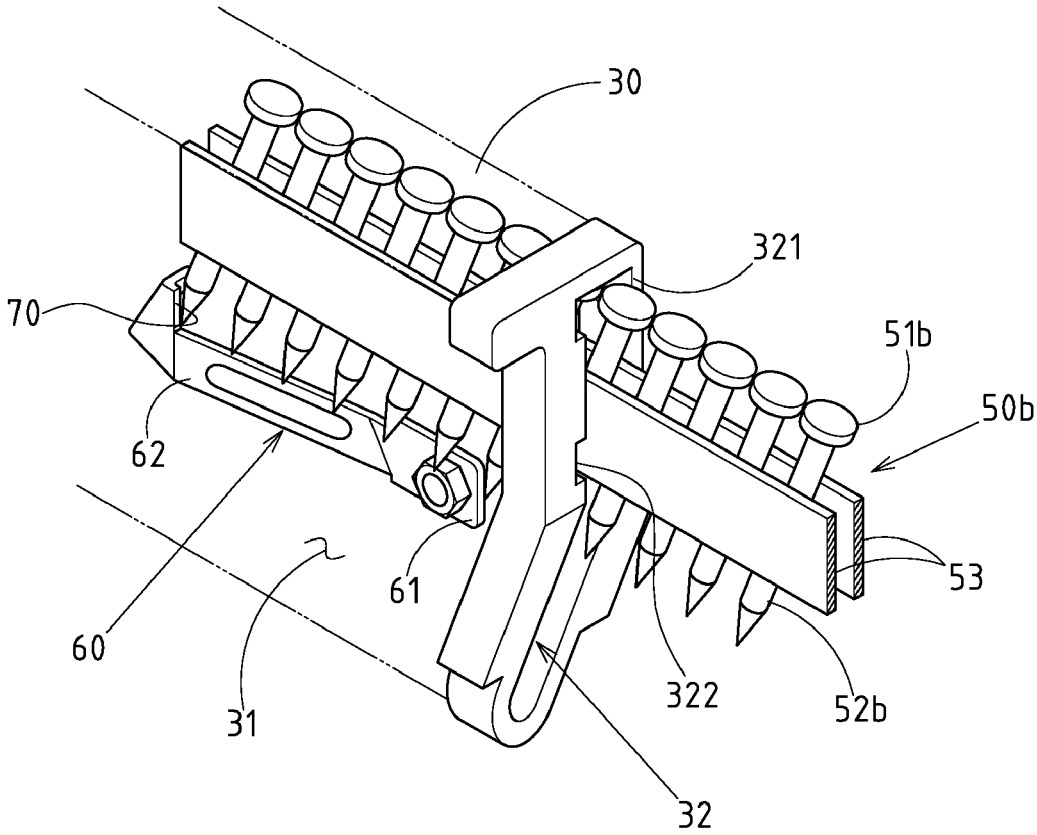
FIG. 4 shows an exploded and isolated perspective view of the spring stopped by the stopper when the short collated nails are incorrectly installed into the nail cartridge, the short collated nails being misaligned.
Figure 5:
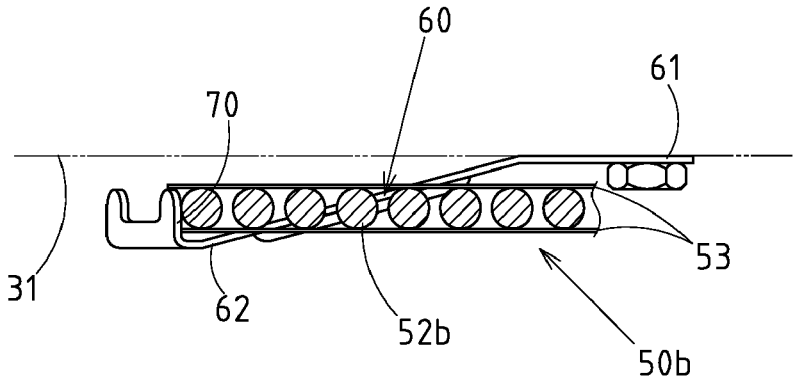
FIG. 5 shows a top plan view of the short collated nails and spring of FIG. 4.

FIGS. 3, 4, and 5 depict preferred embodiments of the anti-misfit structure for a nail cartridge of the present invention. The nail cartridge is a component of a nailer used to accommodate and guide collated nails.

Figure 6:
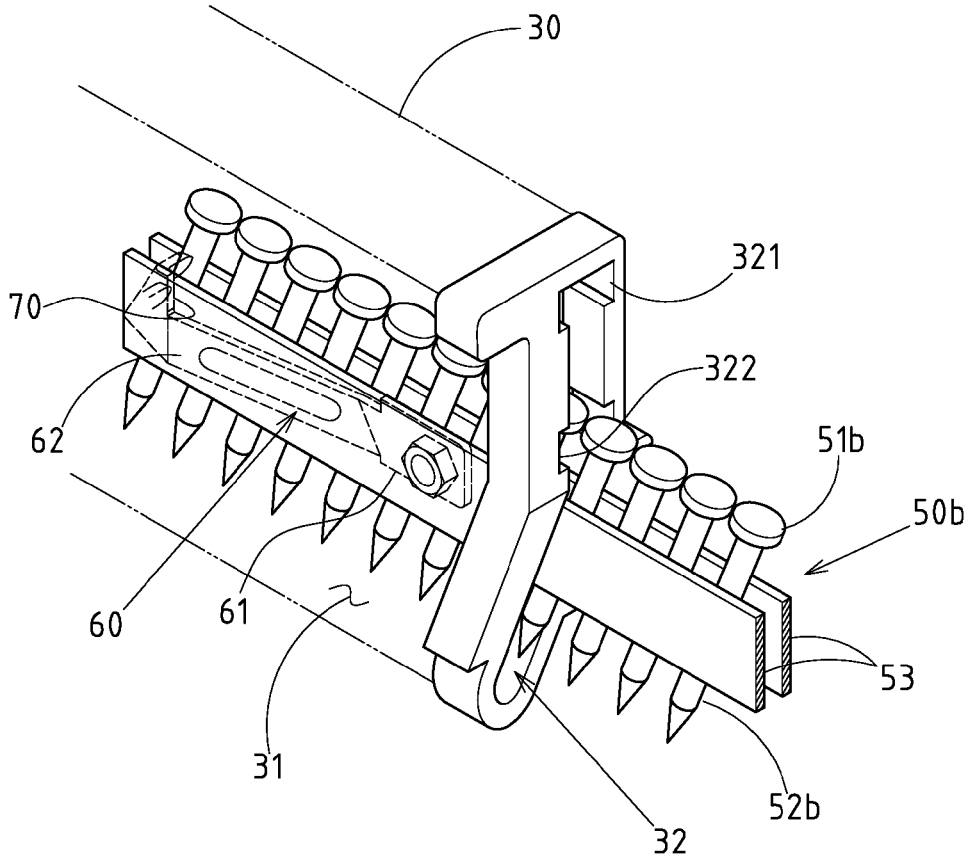
FIG. 6 shows an exploded and isolated perspective view of the present invention when short collated nails are aligned and inserted smoothly into the nail cartridge.
Figure 8:
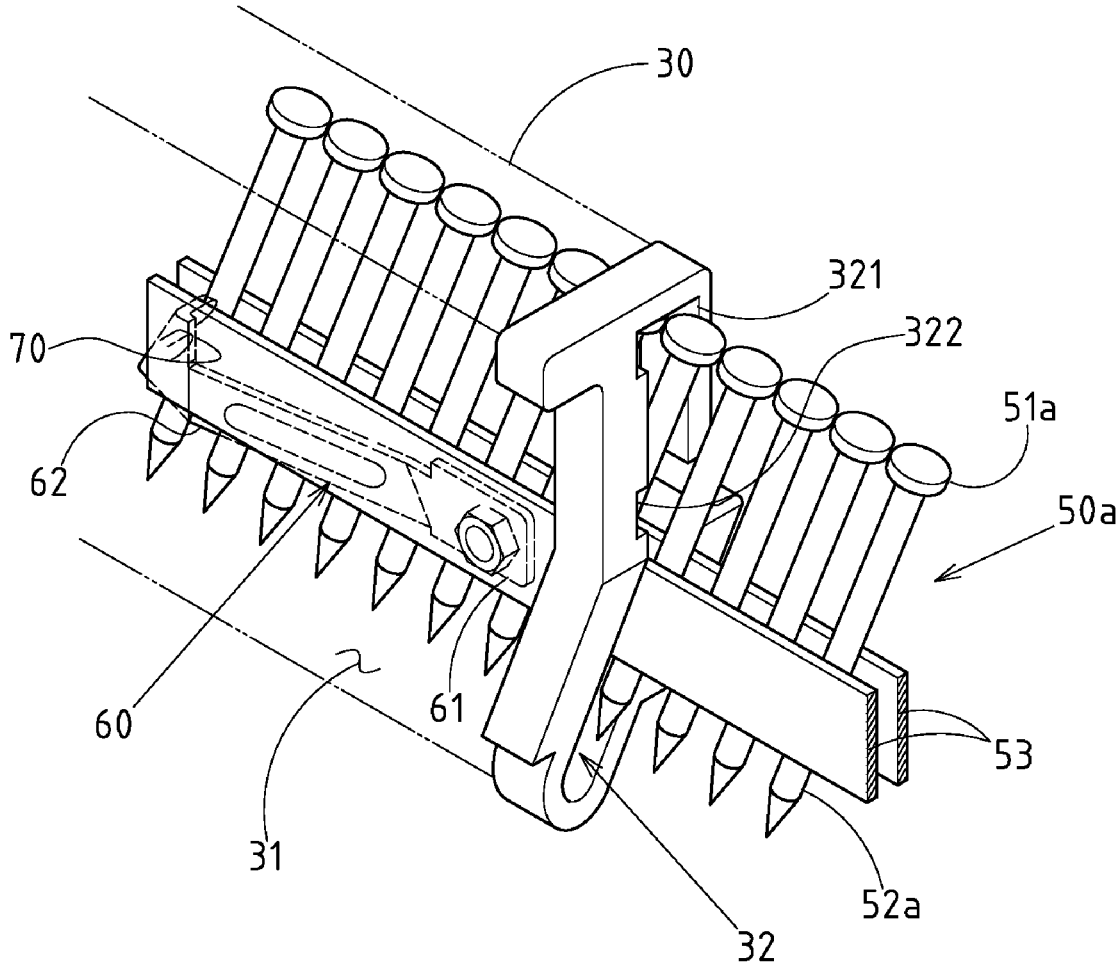
FIG. 8 shows an exploded and isolated perspective of the present invention when the long collated nails are inserted into the nail cartridge.
Figure 10:
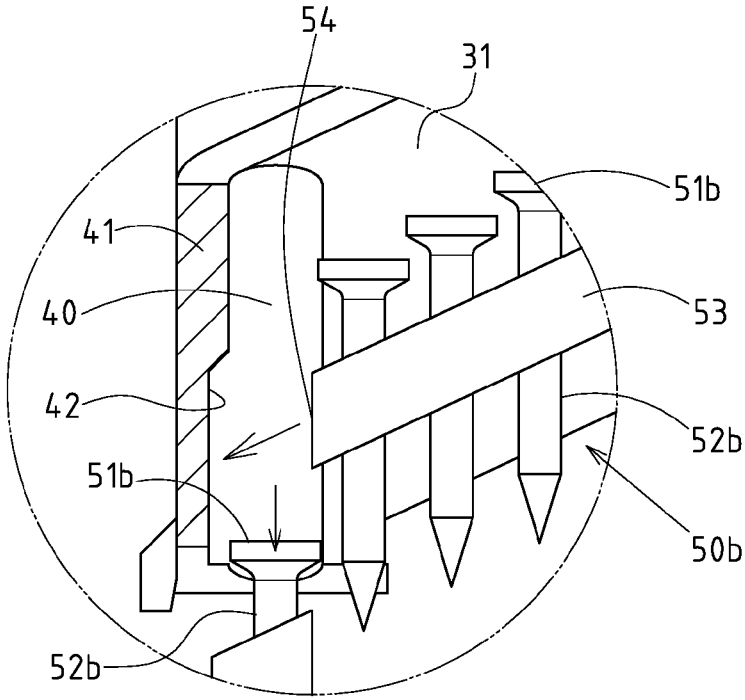
FIG. 10 shows a schematic view of the operation of the relief groove disclosed in FIG. 9, when the nail body of the collated nail is triggered.
Figure 11:
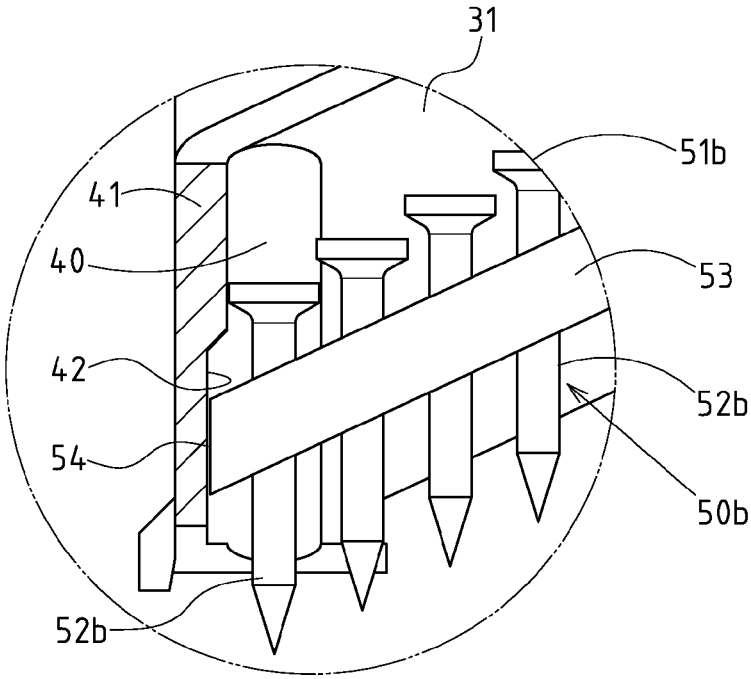
FIG. 11 shows another schematic view of the operation of the relief groove disclosed in FIG. 9, when the connecting band of the triggered nail body of the collated nail inserts into the relief groove.

The present invention includes a nail cartridge 30, which has a nail tank 31. One end of the nail tank is connected to outlet 40 of the nailer, as shown in FIG. 10. The other end of nail tank 31 is provided with an inlet 32 for insertion of preset collated nail. A long nailer head dent 321 and a short nailer head dent 322 are separately placed at top and middle sections of the inlet 32. The long nailer head dent 321 is used for insertion of the nail head 51*a* of a longer collated nail 50*a*, as shown in FIG. 8. The short nailer head dent 321 is used for the nail head 51*b* of a shorter collated nail 50*b*, as shown in FIG. 6. The nail bodies 52*a*, 52*b* of the collated nail 50*a*, 50*b* are linked by left and right connecting band 53, e.g. paper tape.

A spring or snapper 60 is mounted at one side of nail tank 31 of nail cartridge 30 slightly lower than the short nailer head dent 321. The spring 60 includes a fixed end 61 and a swinging end 62. The swinging end 62 normally protrudes towards the nail tank 31, being directed towards a collated nail.

A stopper 70 protrudes from a top end of swinging end 62 of the spring. When the nail head 51*b* of a shorter collated nail 50*b* is mistakenly inserted into long nailer head dent 321 (as shown in FIG. 4), the protruding height of stopper 70 is enough to stop the shorter collated nail so as to prevent misalignment of the collated nails during the nail loading process.

The stopper 70 is integrally formed by the swinging end 62 of the spring. For example, the spring 60 of the present invention is formed by the stopper 70 punched through sheet metal.

The stopper 70 may also be fabricated separately and then assembled at the swinging end 62 of the spring 60.

Figure 9:
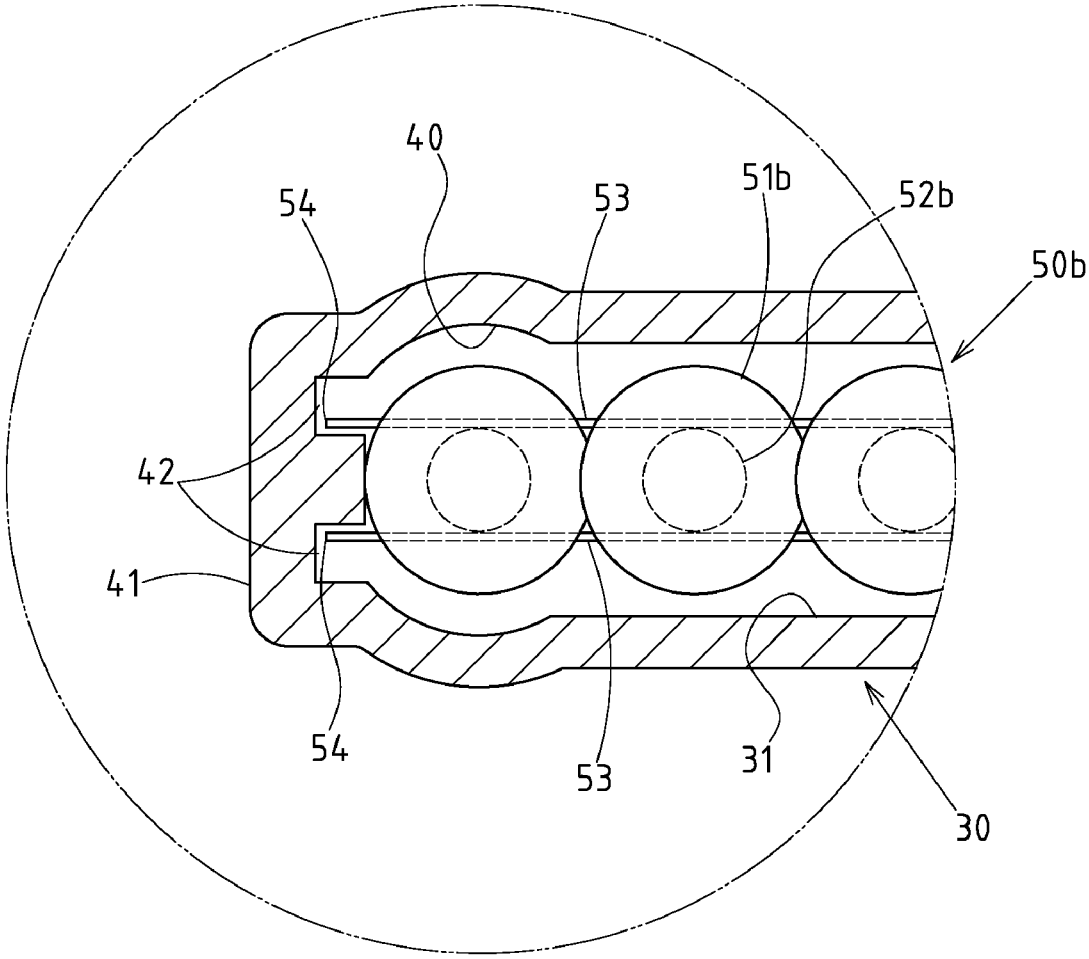
FIG. 9 shows a cross-sectional view of the present invention when a relief groove is set on the end wall of a nail tank in the nail cartridge.

Referring to FIGS. 9 and 10, a relief groove 42 is placed at end wall 41 linking the nail tank 31 of nail cartridge 30 and nailer outlet 40, such that the connecting band 53 of collated nails 50*a*, 50*b* can be inserted. The relief groove 42 can be formed by two interval notch grooves, as shown in FIG. 9, at left and right sides of the collated nails. Referring to FIG. 10, when the nail body 52*b* at a top of the collated nail 50*b* is triggered to protrude from the outlet 40, a space is formed. Meanwhile, the connecting band 53 of the triggered nail body 52*b* is forcibly split. Referring also to FIG. 10, after the triggering behavior is started, the collated nail 50*b* slips towards the outlet 40 to make up the vacancy until nail head 51*b* of nail body 52*b* is stopped at end wall 41 of the outlet 40. In such case, if the end 54 of connecting band 53 exceeds the nail head 51*b*, the collated nails are allowed to be inserted into relief groove 42, ensuring that nail head 51 could be really stopped at the end wall 41 of the outlet 40 for correct positioning and triggering.

Based upon above-specified structure, the present invention operates as detailed herein.

Referring to FIGS. 4 and 5, when the nail head 51*b* of a short collated nail 50*b* is mistakenly inserted into the nail tank 31 from long nailer head dent 321, the bottom of nail body 52*b* of the collated nail is stopped by the stopper 70 at a top of the swinging end 62 of spring 60 within the nail tank 31. In such case, the bottom of collated nail cannot contact other positions of the spring 60 for pressing the swinging end 62. So, the short collated nail 50*b* cannot be inserted, and this installation error can be found, thus preventing the misalignment phenomenon during nail loading.

Figure 7:
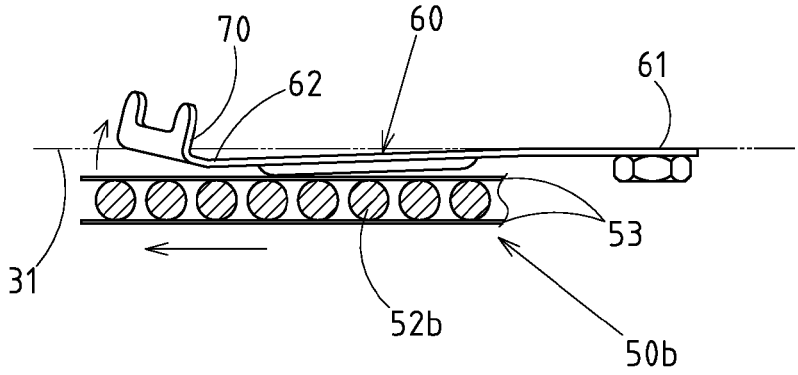
FIG. 7 shows a top plan view of the short collated nails and spring of FIG. 6.

Referring to FIGS. 6 and 7, when the nail head 51*b* of a short collated nail 50*b* is inserted into nail tank 31 from the short nailer head dent 322, one side of the collated nail passes over the fixed end 61 of spring 60. Then, the swinging end 62 is enabled to be pressed on the side wall of nail tank 31, since the swinging end 62 of the spring 60 extends towards the nail tank 31. In such a case, the stopper 70 fails to block off the short collated nail 50*b* with the motion of swinging end 62, enabling the short collated nail 50*b* to be inserted into the nail tank 31 for correct loading.

Referring also to FIG. 8, the nail head 51*a* of a long collated nail 50*a* is inserted into the nail tank 31 from long nailer head dent 321. Thus, it is possible to press the swinging end 62 of spring 60 into the nail tank 31 for correct nail loading, the same way as shown in FIGS. 6 and 7.

Figure 12:
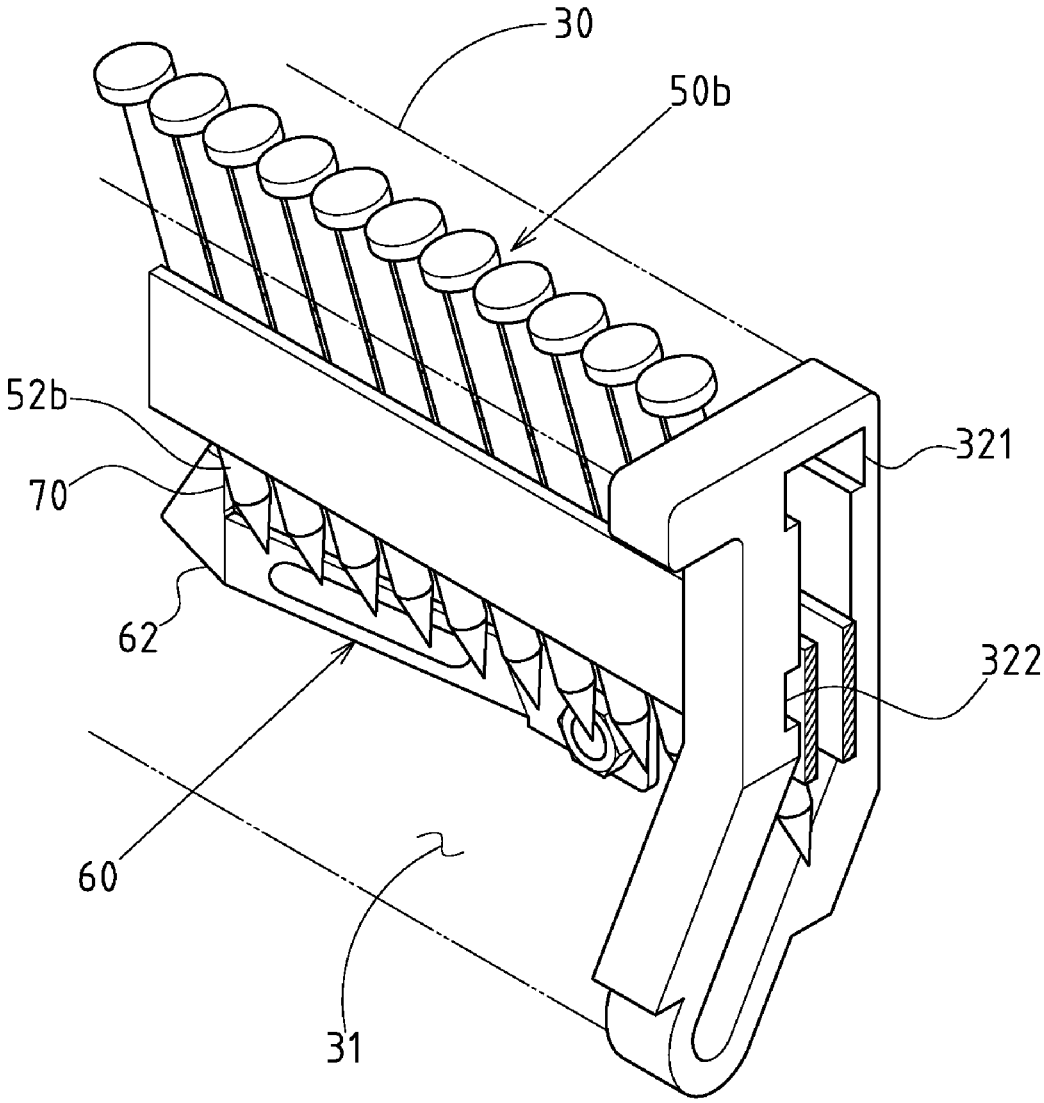
FIGS. 12-14 show isolated perspective views of the blocking by the spring stopper when the reverse nail cartridge enters the nail tank.
Figure 13:
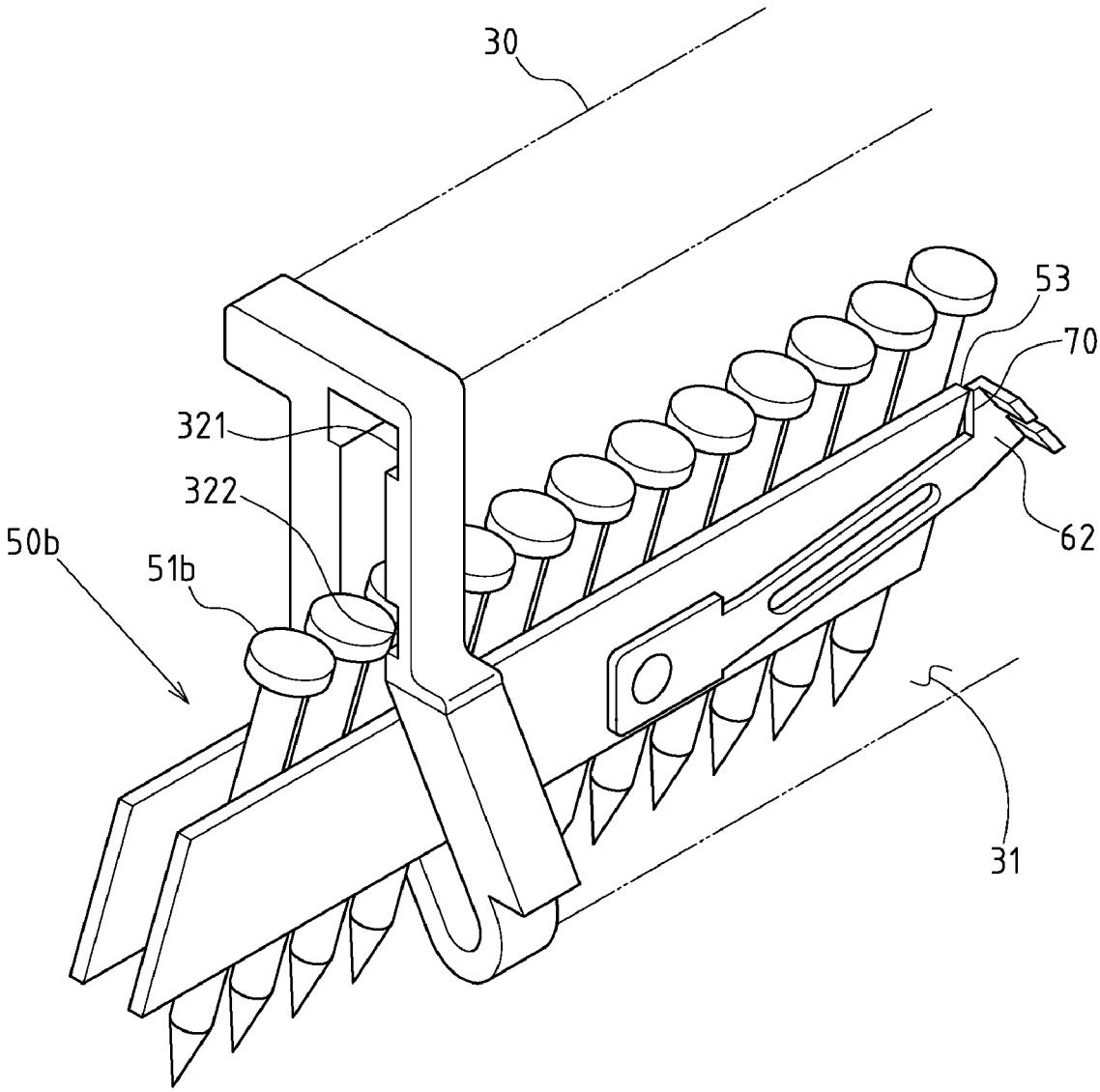
Figure 14:
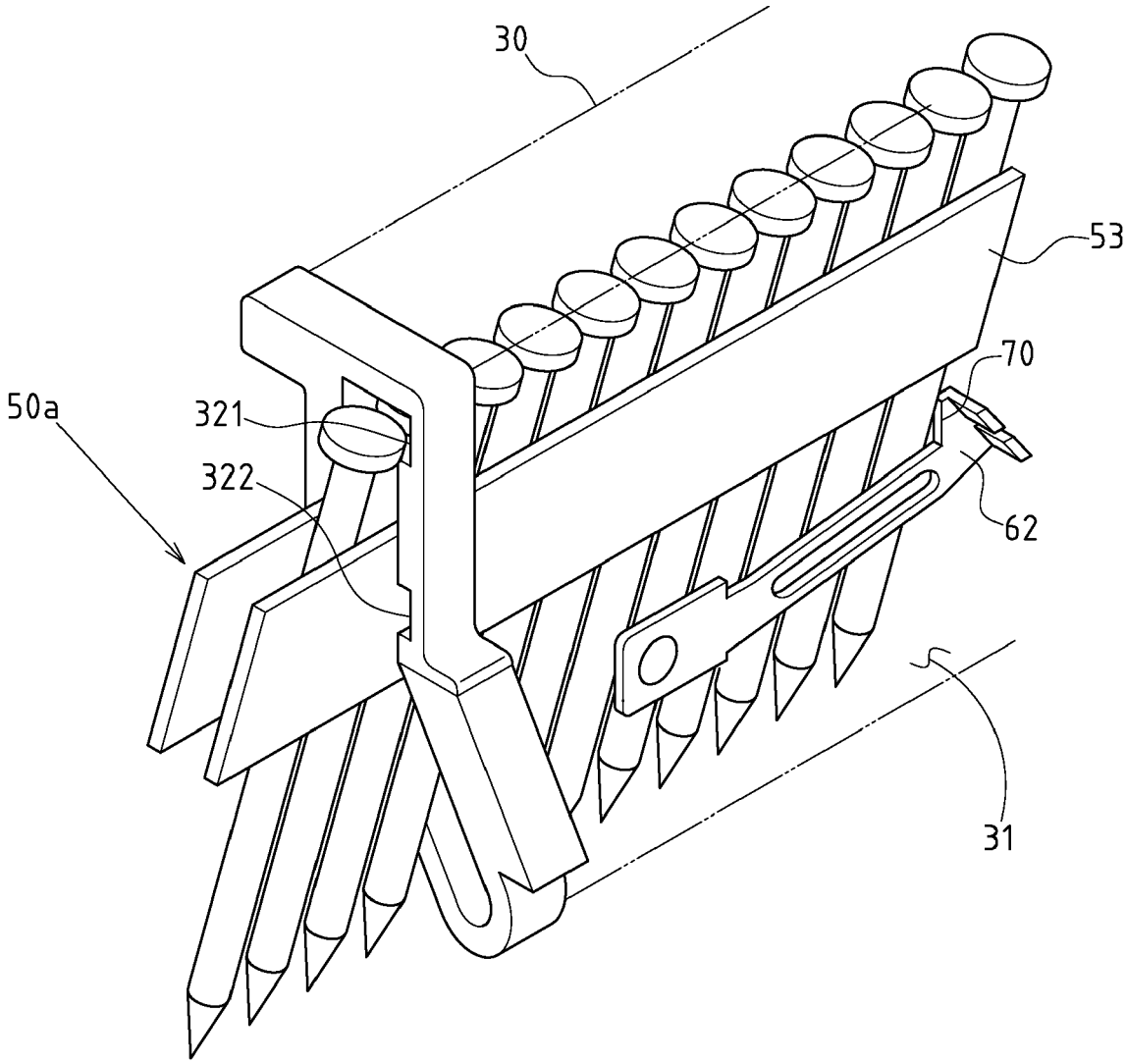

Furthermore, the spring 60 has a protruding stopper 70 on the top of swinging end 62, so as to prevent the nailing process from "displacement", and use the stopper 70 for blockage when the nail body is reversed (the rear side being switched to the front side) into the nail cartridge. As shown in FIG. 12, when the short collated nail 50*b* is placed into the nail tank 31 of the nail cartridge 30 in reverse, the bottom of nail body 52*b* is blocked by the protruding stopper 70 at the top of the swinging end 62 of the spring 60, so that users can identify the mistake and correct the direction. As shown in FIG. 13, when the nail head 51*b* of the short collated nail 50*b* is placed in the nail tank 31 from the correct short nail head dent 322 in reverse, since the connecting band 53 of the short collated nail 50*b* is inclined forward, the top of the swinging end 62 of the spring 60 is blocked to prevent incorrect assembly. As shown in FIG. 14, when the long collated nail 52*a* is placed in the nailed tank 31 of the nail cartridge 30 in reverse, the nail body is inclined forward, and it is blocked by the protruding stopper 70 on the top of the swinging end 62 of the spring 60, so that the reversed long collated nail 52*a* is unable to enter the nail tank 31, thus achieving the purpose of preventing incorrect assembly.

We claim:

1. An apparatus for preventing firing of misfit nails comprising:

a nailer cartridge having a nail tank, said nail tank having an inlet suitable for insertion of a collated nail, said inlet having a first nail head indentation and a second nail head indentation positioned below said first nail head indentation, said first nail head indentation suitable for receiving a head of a long nail, said second nail head indentation suitable for receiving a head of a short nail;

a snapper mounted on one side of said nail tank, said snapper having a fixed end and a swinging end, said swinging end extending toward said nail tank; and a stopper extending from a top of said swinging end, said stopper having a first surface separated by a space from a second surface, said space surface for allowing a head of the short nail to pass therebetween when the short nail is positioned in said second nail head indentation, said first and second surface blocking a movement of the short nail when the short nail is positioned in said first nail indentation.

2. The apparatus of claim 1, said stopper being integrally formed with said swinging end of said snapper.

3. The apparatus of claim 1, said stopper being affixed to said swinging end of said snapper.

4. An apparatus for preventing a firing of misfit nails comprising:

a plurality of collated nails having a nail bodies linking by a connecting band;

a nailer cartridge having a nail tank, said nail tank having an inlet suitable for insertion of a collated nail, said inlet having a first nail head indentation and a second nail head indentation positioned below said first nail head indentation, said first nail head indentation suitable for receiving a head of a long nail, said second nail head indentation suitable for receiving a head of a short nail;

a snapper mounted on one side of said nail tank, said snapper having a fixed end and a swinging end, said swinging end extending toward said nail tank; and a stopper extending from a top of said swinging end, said stopper having a first surface separated by a space from a second surface, said space suitable for allowing a head of the short nail to pass therebetween when the short nail is positioned in said second nail head indentation, said first and second surface5blocking a movement of the short nail when the short nail is positioned in said first nail indentation.

5. The apparatus of claim 4, said stopper being integrally formed with said swinging end of said snapper.

6. The apparatus of claim 4, said stopper being affixed to said swinging end of said snapper.

7. The apparatus of claim 4, said nail tank having a relief groove formed at an end wall thereof, said relief groove linking said nail tank to an outlet thereof, said connecting band being received by said relief groove.

* * * * *